United States Patent [19]

van Manen

[11] 4,030,643

[45] June 21, 1977

[54] CONTENTS-CONSERVING PLUNGER FOR CARTRIDGE

[75] Inventor: Dick T. van Manen, Canandaigua, N.Y.

[73] Assignee: Voplex Corporation, Pittsford, N.Y.

[22] Filed: Dec. 11, 1975

[21] Appl. No.: 639,619

[52] U.S. Cl. ..... 222/386

[51] Int. Cl.[2] ..... B67D 5/42

[58] Field of Search ..... 222/323–327, 222/387, 389, 390, 391, 386

[56] References Cited

UNITED STATES PATENTS

| | | | |
|---|---|---|---|
| 2,920,797 | 1/1960 | Sherbondy | 222/327 |
| 3,066,836 | 12/1962 | Trumbull | 222/327 |
| 3,250,443 | 5/1966 | Abbott, Jr. | 222/327 |
| 3,315,847 | 4/1967 | Trumbull | 222/327 |

*Primary Examiner*—Allen N. Knowles
*Assistant Examiner*—Norman L. Stack, Jr.
*Attorney, Agent, or Firm*—Stonebraker, Shepard & Stephens

[57] ABSTRACT

A cartridge plunger has a flexible forward wall with a forwardly extending central projection shaped to fit part way into the nozzle. The flexible forward wall is moved to a rearward position when the plunger engages the contents of the cartridge as it is inserted in the rear end of the cartridge. Although the forward-extending projection displaces some of the contents, the volume made available around the projection from the forward wall being in the rearward position is greater than the volume displaced by the projection. This allows a slight increase in the total volume of contents loadable into the cartridge, and when the plunger is forced against the front of the cartridge, the contents are not only forced out of the cartridge itself, but also from a portion of the nozzle occupied by the forward projection of the plunger. This dispenses the slightly larger volume of cartridge contents more completely for fully delivering a standard volume of contents without change in standardized size and shape of the cartridge.

6 Claims, 7 Drawing Figures

CONTENTS-CONSERVING PLUNGER FOR CARTRIDGE

BACKGROUND OF THE INVENTION

Cartridges for caulking and sealing materials are presently standardized in size and shape, and any change in this would be very expensive. Millions of caulking guns are shaped to accommodate standard size cartridges, and also a substantial capital investment has been made in machinery for handling, filling, and sealing cartridges.

The contents of a cartridge have not been completely dispensible, because a little remains around the front end of the cartridge and in the full volume of the nozzle. The marking of the contents on cartridges ordinarily indicates the total volume placed in the cartridge when initially filled, but not quite all of that volume is available to the user because of the inability to dispense the full volume of the contents. This discrepancy has been noted by interests seeking to protect consumers, and some government regulations now require the cartridge to be marked with the volume of contents actually dispensible. Enlarging the cartridges slightly to accommodate more contents is not a practical way of maintaining the previous total volume marking, because expensive changes would have to be made in machines for filling and sealing the cartridges.

The invention involves recognition of the need for marking standard size cartridges with as large a volume of dispensible contents as possible, and the invention seeks a larger initial volume of contents and more complete dispensing of the contents to make as much of the contents available to the user as possible and to reduce the waste of undispensible contents. The invention also aims to achieve this without requiring substantial changes in machines for filling and sealing cartridges or in guns already in use for dispensing material from cartridges.

SUMMARY OF THE INVENTION

The invention is a contents-conserving cartridge plunger having an annular wall for engaging the inside of the cartridge in the usual way. The plunger has a flexible forward wall integral with the forwardmost region of the annular wall and movable between forward and rearward positions. A projection extends forward from the central region of the forward wall and is shaped to fit part way into the nozzle, and the forward wall is in its rearward position when it is seated in the rear end of the cartridge. In this position, the projection extends forward of a plane intersecting the forwardmost region of the annular wall, but the volume of this portion of the projection is less than the volume of contents around the projection in an available space rearward of the plane. This allows a slight increase in the total volume of contents, and when the plunger is forced against the forward end of the cartridge, the projection extends part way into the nozzle for dispensing the contents not only from the cartridge, but from a portion of the nozzle. The forward wall is preferably molded in its forward position and moved to its rearward position by engagement with the contents as the plunger is inserted into the rear end of the cartridge, and spacer projections are preferably arranged around the forward projection to prevent sealing off the nozzle before the forward wall is forced against the forward end of the cartridge.

DRAWINGS

DETAILED DESCRIPTION

Figure 1:
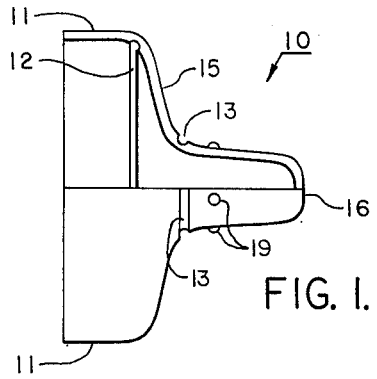
FIG. 1 is a half cross-sectioned, elevational view of a preferred embodiment of the inventive plunger in its forward position.
Figure 2:
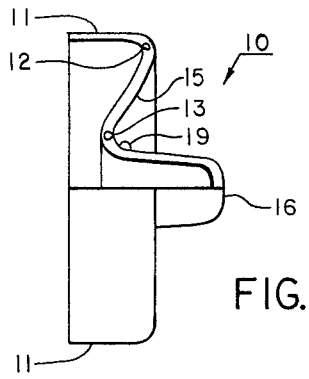
FIG. 2 is a half cross-sectional, elevational view of the plunger of FIG. 1 in its rearward position.

Plunger 10 is molded of resin material, preferably in approximately the form shown in FIG. 1, although it can also have the initial approximate form of FIG. 2. It includes an annular wall 11 fitting the inside surface of a cylindrical cartridge so that the contents of the cartridge are pushed along ahead of plunger 10 as wall 11 slides along the inside of the cartridge. The resin material of plunger 10 is preferably resilient so that plunger 10 can move back and forth between its forward position as shown in FIG. 1 and its rearward position as shown in FIG. 2. To facilitate flexure between the positions of FIGS. 1 and 2, annular grooves 12 and 13 are preferably molded into plunger 10 to reduce the thickness of the resin material in the region of grooves 12 and 13 and make plunger 10 more sharply bendable along the groove lines.

Inside of annular wall 11, plunger 10 has a flexible forward wall 15 with a projection 16 extending forward from the central region of forward wall 15. Projection 16 is shaped for extending part way into the nozzle of a cartridge as explained more fully below.

Figure 3:
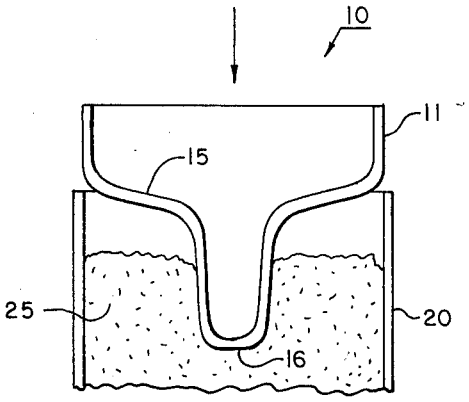
FIGS. 3 and 4 are cross-sectional views of the inventive plunger being inserted and seated in the rear end of a cartridge.
Figure 4:
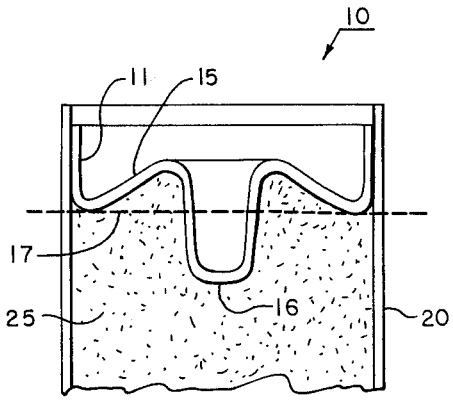

Plunger 10 is preferably inserted into the rear end of a cartridge 20 with the forward wall 15 and projection 16 in the forward position as best shown in FIG. 3. This can be done with existing machinery with ony slight modification to accommodate the different shape of plunger 10. Projection 16 first enters contents 25 which are displaced along the surface of projection 16 and forward wall 15. The generally convex shape of plunger 10 allows air to escape from the rear end of cartridge 20 as plunger 10 is advanced, so that no air is trapped between contents 25 and plunger 10. As plunger 10 is pushed into the fully seated position, the pressure exerted by contents 25 moves the forward wall 15 to the rearward position as shown in FIG. 4. Cartridge 20 is marketed with plunger 10 in the position illustrated in FIG. 4, and the operation of plunger 10 during use of cartridge 20 is explained below.

First, it is important to understand a volumetric relationship between plunger 10 and contents 25. This is best explained relative to an imaginary plane 17 shown in a broken line in FIG. 4. Plane 17 intersects the forwardmost region of annular wall 11 where forward wall 15 integrally joins with annular wall 11, and plane 17 lies in the region of the plane forward wall of conventional prior art plungers. So plane 17 offers a reference for comparison of plunger 10 with the normally flat-forward-wall plungers previously used in the art.

Projection 16 extends forward of plane 17 and thereby displaces some of the contents 25. However, forward wall 15 in its rearward position as shown in FIG. 4 lies rearwardly of plane 17 and allows a volume of contents 25 to lie rearwardly of plane 17 in the space around projection 16. Moreover, the volume of the portion of projection 16 extending forward of plane 17 is less than the volume of contents 25 lying rearwardly of plane 17 in the space adjacent forward wall 15 surrounding projection 16.

The difference in the larger volume of contents 25 behind plane 17, compared with the volume of contents displaced by the portion of projection 16 extending forward of plane 17, allows a slight increase in the total volume of contents 25 over the volume that can be contained within cartridge 20 forward of plane 17. This means that compared with a prior art plunger having a flat forward face, plunger 10 allows cartridge 20 to be filled with a slightly larger volume of contents 25 without shortening the axial extent of annular wall 11, which is important for a leakproof sliding fit within cartridge 20. This larger volume of contents 25 is also achieved without changing the dimensions of cartridge 20 or requiring substantial changes in the equipment presently in use for filling cartridges.

Figure 7:
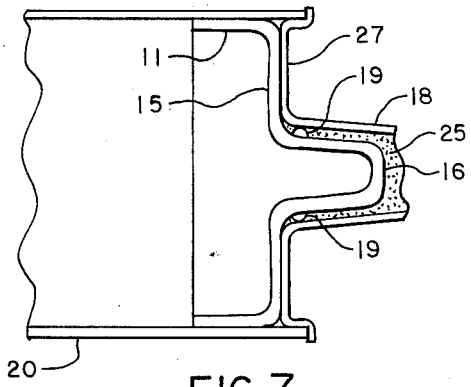

Furthermore, when plunger 10 is finally driven against the forward wall 15 of cartridge 20, as best shown in FIG. 7, projection 16 extends part way into nozzle 18 for dispensing not only the contents 25 within cartridge 20, but also a potion of the contents 25 that would otherwise remain in the rear end of the nozzle 18. The combination of a greater initial volume of contents 25 plus more complete dispensing of contents 25 by projection 16 extending into nozzle 18 allows the same size cartridge 20 to be marked with the same volume of contents as previously, and yet have the capacity for dispensing in full the marked volume. In other words, the familiar 12-ounce cartridge can still be marked as the 1-ounce size, because it can be filled with a little more than 12 ounces and can dispense a full 12 ounces.

Figure 5:
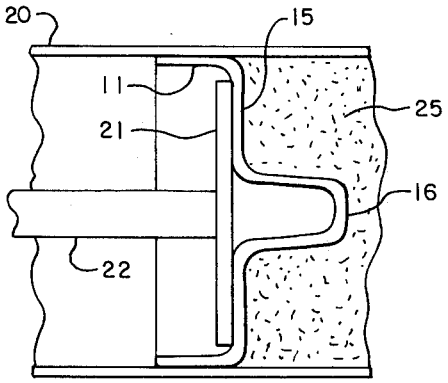
FIGS. 5–7 are cross-sectional views of the inventive plunger in various stages of operation.
Figure 6:
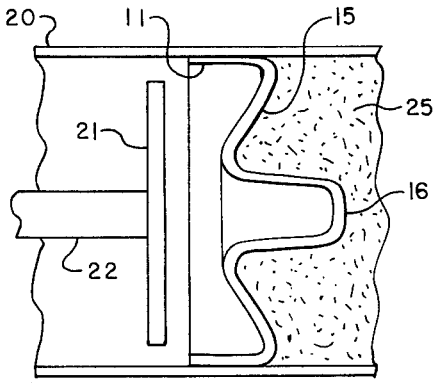

Plunger 10 can be driven through cartridge 20 with a conventional mechanical disk 21 pushed by a rod 22, as shown in FIGS. 5 and 6, or by fluid pressure applied directly to the rear of plunger 10, as shown in FIG. 7. As disk 21 is forced against plunger 10, forward wall 15 and projection 16 are urged to the position of FIG. 5 to force contents 25 forward while annular wall 11 slides along the inside of cartridge 20. Plunger 10 also reduces drool when dispensing is interrupted, because of the capacity of plunger 10 to move its forward wall 15 back to the rearward position as shown in FIG. 6 to relieve compressive force on contents 25 if disk 21 is retracted to allow this.

When plunger 10 is advanced through cartridge 20 by fluid pressure, forward wall 15 can be pushed all the way to the forward position as illustrated in FIG. 1. Projection 16 is preferably prevented from being seated in nozzle 18 to seal off and trap a volume of contents from being dispensed through nozzle 18 when plunger 10 is advanced by fluid pressure. This is preferably accomplished by several projections 19 arranged around projection 16 to engage the rear end of nozzle 18 and provide clear space between projections 19. Then forward wall 15 of plunger 10 can be driven flat against forward wall 27 of cartridge 20 to dispense practically all of contents 25 through nozzle 18 and past projection 16, even after projection 16 has partially entered nozzle 18.

Plunger 10 conserves contents 25 by more complete dispensing of contents 25, and also allows a slightly greater initial volume of contents 25 without changing the size or shape of cartridge 20 and without requiring substantial changes in machinery for filling and handling cartridge 20. It thus solves a problem in the art of fully dispensing the marked volume of the cartridge without reducing the amount of the marked volume. Those skilled in the art will appreciate the different resin materials that can be used and different configurations that the inventive plunger can have, once the basic principle of the invention is understood.

I claim:

1. A plunger for a cartridge having an open rear end and a dispensing nozzle at a forward end, said plunger comprising relative to said cartride:

a. an annular wall for engaging the inside of said cartridge;

b. a flexible forward wall integral with the forwardmost region of said annular wall and movable between forward and rearward positions;

c. said forwardmost region of said annular wall curving into said forward wall in a relatively small radius of curvature of more than 90°;

d. a projection extending forward from the central region of said forward wall, said projection being shaped to fit into a rearward region of said nozzle;

e. said forward wall curving into said projection in a relatively small radius of curvature of more than 90°;

f. said forward wall being in said rearward position when said plunger is seated in said rear end of said cartridge;

g. said projection extending forward of a plane intersecting said forwardmost region of said annular wall when said forward wall is in said rearward position;

h. the volume of the portion of said projection extending forward of said plane being less than the volume of said contents around said projection in a space rearward of said plane when said plunger is seated in said rear end of said cartridge and said forward wall is in said rearward position;

i. said forward wall of said plunger being movable forward to said plane to dispense said volume of said contents around said projection when said forward wall is forced against said forward end of said cartridge; and j. said forward movement of said forward wall being arranged to force substantially all of said projection into said rearward region of said nozzle for dispensing most of said contents from said rearward region of said nozzle.

2. The plunger of claim 1 wherein said forward wall has a pair of annular regions of reduced thickness arranged respectively in regions of said curvatures to facilitate flexure between said forward and rearward positions.

3. The plunger of claim 1 wherein said forward wall is molded in said forward position and flexes to said rearward position when inserted into said rear end of said cartridge.

4. The plunger of claim 1 including spacer projections around said forward projection to prevent sealing off said nozzle withsaid forward projection before said forward wall is forced against said forward end of said cartridge.

5. The plunger of claim 4 wherein said forward wall is molded in said forward position and flexes to said rearward position when inserted into said rear end of said cartridge.

6. The plunger of claim 5 wherein said forward wall has a pair of annular regions of reduced thickness arranged respectively in regions of said curvatures to facilitate flexure between said forward and rearward positions.

* * * * *